US011454069B2

(12) United States Patent
Tambs et al.

(10) Patent No.: US 11,454,069 B2
(45) Date of Patent: Sep. 27, 2022

(54) SYSTEM AND METHOD FOR HANDLING A TUBULAR MEMBER

(71) Applicant: Cameron International Corporation, Houston, TX (US)

(72) Inventors: Erling Tambs, Kristiansand (NO); Zhijun Zhou, Shanghai (CN); Thomas Vatne, Kristiansand (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 18 days.

(21) Appl. No.: 16/854,461

(22) Filed: Apr. 21, 2020

(65) Prior Publication Data

US 2021/0324689 A1 Oct. 21, 2021

(51) Int. Cl.
*E21B 19/08* (2006.01)
*E21B 19/06* (2006.01)

(52) U.S. Cl.
CPC ..... *E21B 19/06* (2013.01); *E21B 19/08* (2013.01)

(58) Field of Classification Search
CPC ..... E21B 19/06; E21B 19/08; E21B 19/20
See application file for complete search history.

(56) References Cited

U.S. PATENT DOCUMENTS

| | | | |
|---|---|---|---|
| 1,039,287 | A | 9/1912 | Hudson |
| 5,667,026 | A | 9/1997 | Lorenz et al. |
| 6,089,333 | A | 7/2000 | Rise |
| 6,212,976 | B1 | 4/2001 | Stogner |
| 6,412,553 | B1 | 7/2002 | Akerlund |
| 6,513,605 | B1 | 2/2003 | Lodden |
| 6,591,471 | B1 | 7/2003 | Hollingsworth |
| 6,688,398 | B2 | 2/2004 | Pietras |
| 6,695,559 | B1 | 2/2004 | Pietras |
| 6,722,231 | B2 | 4/2004 | Hauk et al. |
| 6,725,949 | B2 | 4/2004 | Seneviratne |
| 6,821,071 | B2 | 11/2004 | Woolslayer et al. |
| 6,860,337 | B1 | 3/2005 | Orr et al. |
| 6,997,265 | B2 | 2/2006 | Berry |
| 7,021,374 | B2 | 4/2006 | Pietras |

(Continued)

FOREIGN PATENT DOCUMENTS

| | | | | |
|---|---|---|---|---|
| CA | 2863507 A1 | 8/2013 | | |
| WO | WO-2008028302 A1 * | 3/2008 | ..... | E21B 19/168 |

(Continued)

*Primary Examiner* — Giovanna Wright
*Assistant Examiner* — Ronald R Runyan
(74) *Attorney, Agent, or Firm* — Kelly McKinney

(57) ABSTRACT

A system for handling a tubular member includes a gripping assembly configured to grip the tubular member. The system also includes a horizontal actuator configured to move the gripping assembly and the tubular member horizontally between a rack and alignment with a wellbore while the tubular member is gripped by the gripping assembly. The system also includes a vertical actuator coupled to the gripping assembly, the horizontal actuator, or both. The vertical actuator is configured to move the gripping assembly and the tubular member vertically while the tubular member is gripped by the gripping assembly and in alignment with the wellbore. The system also includes a rotating assembly coupled to the gripping assembly and configured to rotate the tubular member while the tubular member is gripped by the gripping assembly and in alignment with the wellbore.

15 Claims, 6 Drawing Sheets

(56) References Cited

U.S. PATENT DOCUMENTS

| | | | |
|---|---|---|---|
| 7,028,787 | B2 | 4/2006 | Allen et al. |
| 7,043,814 | B2 | 5/2006 | Hollingsworth et al. |
| 7,188,548 | B2 | 3/2007 | Liess |
| 7,213,656 | B2 | 5/2007 | Pietras |
| 7,219,744 | B2 | 5/2007 | Pietras |
| 7,225,865 | B2 | 6/2007 | Akerlund |
| 7,228,919 | B2 | 6/2007 | Fehres et al. |
| 7,246,983 | B2 | 7/2007 | Zahn et al. |
| 7,249,639 | B2 | 7/2007 | Belik |
| 7,281,451 | B2 | 10/2007 | Schulze Beckinghausen |
| 7,353,880 | B2 | 4/2008 | Pietras |
| 7,371,289 | B2 | 5/2008 | Reinholdt et al. |
| 7,448,456 | B2 | 11/2008 | Shahin et al. |
| 7,451,826 | B2 | 11/2008 | Pietras |
| 7,461,830 | B2 | 12/2008 | Newman |
| 7,509,722 | B2 | 3/2009 | Shahin et al. |
| 7,510,028 | B2 | 3/2009 | Welsh |
| 7,654,313 | B2 | 2/2010 | Angman |
| 7,665,531 | B2 | 2/2010 | Pietras |
| 7,707,914 | B2 | 5/2010 | Pietras et al. |
| 7,802,636 | B2 | 9/2010 | Childers et al. |
| 7,836,795 | B2 | 11/2010 | Vatne |
| 7,861,618 | B2 | 1/2011 | Pietras et al. |
| 7,896,084 | B2 | 3/2011 | Haugen |
| 7,921,750 | B2 | 4/2011 | Pietras |
| 8,037,786 | B2 | 10/2011 | Vatne |
| 8,052,370 | B2 | 11/2011 | Dekker et al. |
| 8,136,603 | B2 | 3/2012 | Schneider |
| 8,172,497 | B2 | 5/2012 | Orgeron et al. |
| 8,186,455 | B2 | 5/2012 | Childers et al. |
| 8,192,128 | B2 | 6/2012 | Orgeron |
| 8,215,887 | B2 | 7/2012 | Fikowski et al. |
| 8,281,867 | B2 | 10/2012 | Belik |
| 8,317,448 | B2 | 11/2012 | Hankins et al. |
| 8,439,128 | B2 | 5/2013 | Vatne |
| 8,550,761 | B2 | 10/2013 | Belik et al. |
| 8,567,512 | B2 | 10/2013 | Odell, II et al. |
| 8,584,773 | B2 | 11/2013 | Childers et al. |
| 8,678,112 | B2 | 3/2014 | Vatne |
| 8,876,452 | B2 | 11/2014 | Orgeron et al. |
| 8,961,093 | B2 | 2/2015 | Springett et al. |
| 9,010,410 | B2 | 4/2015 | Story |
| 9,068,406 | B2 | 6/2015 | Clasen et al. |
| 9,091,128 | B1 | 7/2015 | Orgeron et al. |
| 9,303,468 | B2 | 4/2016 | Selzer et al. |
| 9,354,623 | B2 | 5/2016 | Magnuson |
| 9,410,385 | B2 | 8/2016 | Childers et al. |
| 9,562,407 | B2 | 2/2017 | Magnuson |
| 9,631,443 | B2 | 4/2017 | Folk |
| 9,863,194 | B2 | 1/2018 | Larkin |
| 10,006,259 | B2 | 6/2018 | Angelle et al. |
| 10,006,260 | B2 | 6/2018 | Webre et al. |
| 10,012,038 | B2 | 7/2018 | Richardson et al. |
| 10,036,216 | B2 | 7/2018 | Perez |
| 10,047,576 | B2 | 8/2018 | Wright et al. |
| 10,060,200 | B2 | 8/2018 | Rice, II |
| 10,066,451 | B2 | 9/2018 | Ritter et al. |
| 10,071,888 | B2 | 9/2018 | Guidry |
| 10,073,446 | B1 | 9/2018 | Snow et al. |
| 10,113,374 | B2 | 10/2018 | Tengliden et al. |
| 10,132,126 | B2 | 11/2018 | Helms et al. |
| 10,132,660 | B2 | 11/2018 | Newton et al. |
| 10,145,188 | B2 | 12/2018 | Smith et al. |
| 10,151,156 | B2 | 12/2018 | Gordon et al. |
| 10,156,095 | B1 | 12/2018 | Keast et al. |
| 10,167,688 | B2 | 1/2019 | Jelgert et al. |
| 10,174,567 | B2 | 1/2019 | Wase |
| 10,196,866 | B2 | 2/2019 | Stoldt et al. |
| 10,214,975 | B2 | 2/2019 | Holand et al. |
| 10,214,977 | B2 | 2/2019 | Pilgrim |
| 10,246,949 | B2 | 4/2019 | Wentworth et al. |
| 10,267,103 | B2 | 4/2019 | Rice, II |
| 10,294,739 | B2 | 5/2019 | Orr et al. |
| 10,329,841 | B2 | 6/2019 | Van Duivendijk et al. |
| 10,443,325 | B2 | 10/2019 | Zheng et al. |
| 10,465,455 | B2 | 11/2019 | Berry et al. |
| 10,465,456 | B2 | 11/2019 | Gupta et al. |
| 10,513,895 | B2 | 12/2019 | Holand et al. |
| 10,544,633 | B2 | 1/2020 | Huchon |
| 10,590,718 | B2 | 3/2020 | Skjaerseth et al. |
| 10,648,253 | B2 | 5/2020 | Kaasin |
| 10,697,260 | B2 | 6/2020 | Henriksen et al. |
| 10,711,540 | B2 | 7/2020 | Holand et al. |
| 10,718,162 | B2 | 7/2020 | Van Duivendijk et al. |
| 2015/0315855 | A1 | 11/2015 | Dewald et al. |
| 2016/0060981 | A1 | 3/2016 | Larkin |
| 2016/0291201 | A1 | 10/2016 | Tunc |
| 2018/0245410 | A1 | 2/2018 | Skjaerseth |
| 2018/0058159 | A1 | 3/2018 | Buchanan |
| 2018/0128065 | A1 | 5/2018 | Patterson |
| 2018/0266196 | A1 | 5/2018 | Richardson |
| 2018/0179834 | A1 | 6/2018 | Gordon |
| 2018/0292242 | A1 | 6/2018 | Newton |
| 2018/0298693 | A1 | 10/2018 | Van Duivendijk et al. |
| 2018/0321064 | A1 | 11/2018 | Newton et al. |
| 2018/0321331 | A1 | 11/2018 | Finlay et al. |
| 2018/0328112 | A1 | 11/2018 | Berry et al. |
| 2018/0328124 | A1 | 11/2018 | Finlay et al. |
| 2018/0334865 | A1 | 11/2018 | Miller et al. |
| 2018/0340379 | A1 | 11/2018 | Gruess et al. |
| 2018/0340380 | A1 | 11/2018 | Wern et al. |
| 2018/0347292 | A1 | 12/2018 | Ritter et al. |
| 2018/0355685 | A1 | 12/2018 | Perez |
| 2018/0371850 | A1 | 12/2018 | McGarian et al. |
| 2019/0003270 | A1 | 1/2019 | Clostio, Jr. et al. |
| 2019/0003271 | A1 | 1/2019 | Clarke et al. |
| 2019/0004882 | A1 | 1/2019 | Martin et al. |
| 2019/0024466 | A1 | 1/2019 | Richardson |
| 2019/0145194 | A1 | 5/2019 | Berry et al. |
| 2019/0145224 | A1 | 5/2019 | Berry et al. |
| 2019/0271199 | A1 | 9/2019 | McCabe et al. |

FOREIGN PATENT DOCUMENTS

| | | | | |
|---|---|---|---|---|
| WO | WO-2015133895 | A1 * | 9/2015 | ..... E21B 19/10 |
| WO | 2017192814 | A2 | 11/2017 | |
| WO | 2017193204 | A1 | 11/2017 | |
| WO | 2018045259 | A1 | 3/2018 | |
| WO | 2018195028 | A1 | 10/2018 | |
| WO | 2018199754 | A1 | 11/2018 | |
| WO | 2018213175 | A1 | 11/2018 | |
| WO | 2019010036 | A1 | 1/2019 | |
| WO | 2019013644 | A1 | 1/2019 | |

* cited by examiner

SYSTEM AND METHOD FOR HANDLING A TUBULAR MEMBER

BACKGROUND

Tubular members may be coupled together at the surface of a wellsite to form a tubular string that is then run into a wellbore formed in a subterranean formation. To increase a length of the tubular string, a first device may grip a tubular member, which may be stored in a pipe rack. The first device may then transport the tubular member from the pipe rack to a position that is above the tubular string in the wellbore. The first device may then lower the tubular member such that a lower end of the tubular member is stabbed into an upper end of the tubular string. The first device may then release the tubular member. After the first device releases the tubular member, a second device may grip the tubular member and rotate the tubular member to connect the tubular member to the tubular string, thereby increasing the length of the tubular string. The second device may be or include an iron roughneck.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system for handling a tubular member is disclosed. The system includes a gripping assembly configured to grip the tubular member. The system also includes a horizontal actuator configured to move the gripping assembly and the tubular member horizontally between a rack and alignment with a wellbore while the tubular member is gripped by the gripping assembly. The system also includes a vertical actuator coupled to the gripping assembly, the horizontal actuator, or both. The vertical actuator is configured to move the gripping assembly and the tubular member vertically while the tubular member is gripped by the gripping assembly and in alignment with the wellbore. The system also includes a rotating assembly coupled to the gripping assembly and configured to rotate the tubular member while the tubular member is gripped by the gripping assembly and in alignment with the wellbore.

In another embodiment, the system includes a rack. The rack includes a shaft and a holder coupled to the shaft. The tubular member is configured to be stored at least partially within the holder. The system also includes a first horizontal actuator coupled to the rack. The system also includes a first device coupled to the first horizontal actuator. The first device includes a gripping assembly configured to grip the tubular member. The first device also includes a rotating assembly coupled to the gripping assembly and configured to rotate the tubular member while the tubular member is gripped by the gripping assembly. The gripping assembly is configured to actuate between an open position and a closed position. The first horizontal actuator is configured to move the first device such that the tubular member becomes positioned at least partially within the gripping assembly when the gripping assembly is in the open position. The gripping assembly is configured to grip the tubular member when the gripping assembly is in the closed position. The first horizontal actuator is configured to move the first device and the tubular member away from the rack while the tubular member is gripped by the gripping assembly. The rotating assembly is configured to rotate the tubular member after the first device and the tubular member have been moved away from the rack and while the tubular member is gripped by the gripping assembly.

A method for handling a tubular member is also disclosed. The method includes moving a device toward the tubular member using a horizontal actuator coupled to the device. The method also includes actuating a gripping assembly of the device into an open position. The method also includes positioning the device such that the tubular member is at least partially within the gripping assembly. The method also includes actuating the gripping assembly into a closed position such that the gripping assembly contacts and grips the tubular member. The method also includes moving the tubular member from a first location to a second location using the device and the horizontal actuator while the tubular member is gripped by the gripping assembly. The method also includes rotating the tubular member using a rotating assembly of the device when the tubular member is in the second location and the tubular member is gripped by the gripping assembly.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
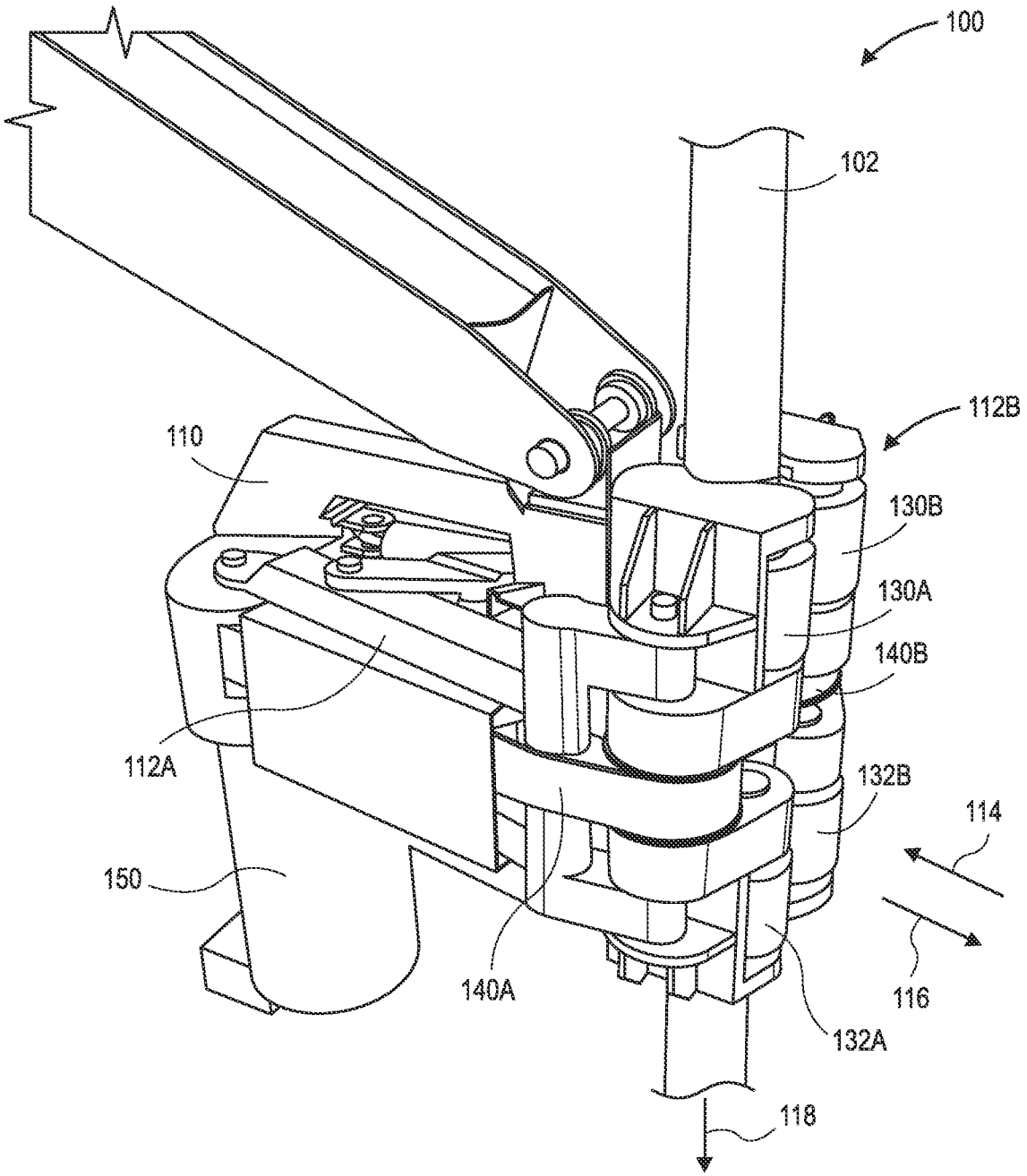
FIG. 1 illustrates a perspective view of a device for handling a tubular member, according to an embodiment.

FIG. 1 illustrates a perspective view of a device 100 for handling a tubular member 102, according to an embodiment. The device 100 may include a body 110 having a gripping assembly coupled thereto or integral therewith. The gripping assembly may be or include two or more arms 112A, 112B. The arms 112A, 112B may be configured to pivot between an open position and a closed position. In the open position, the arms 112A, 112B may be spaced apart by a distance that is greater than or equal to a width of the tubular member 102 such that the tubular member 102 may be introduced laterally into the arms 112A, 112B (as shown by arrow 114) and/or removed laterally from the arms 112A, 112B (as shown by arrow 116). When the arms 112A, 112B pivot into the closed position around the tubular member 102, the arms 112A, 112B may grip the tubular member 102 to prevent the tubular member 102 from being removed laterally from the arms 112A, 112B (as shown by arrow 116) and/or being removed vertically from the arms 112A, 112B (as shown by arrow 118). The tubular member 102 may be or include a segment of drill pipe, casing, or the like.

The body 110 of the device 100 may also include a clamp (not shown). The clamp may be configured to actuate between an unlocked position and a locked position. In the unlocked position, the arms 112A, 112B may be configured to actuate between the open and closed positions. In the locked position, the arms 112A, 112B may be secured in the closed position.

The body 110 may also have a rotating assembly coupled thereto or integral therewith. In one embodiment, the rotating assembly may include one or more rollers. More particularly, each arm 112A, 112B may have one or more rollers coupled thereto. As shown, the first arm 112A may include one or more upper rollers (one is shown: 130A) and one or more lower rollers (one is shown: 132A). Similarly, the second arm 112B may include one or more upper rollers (one is shown: 130B) and one or more lower rollers (one is shown: 132B). The rollers 130A, 130B, 132A, 132B may be configured to contact (e.g., grip) the tubular member 102 when the arms 112A, 112B are in the closed position. As described in greater detail below, the rollers 130A, 130B, 132A, 132B may also be configured to rotate the tubular member 102 while the tubular member 102 is being gripped.

The body 110 of the device 100 may also include one or more belts (two are shown: 140A, 140B). As shown, the first arm 112A may include the first belt 140A, and the second arm 112B may include the second belt 140B. The belts 140A, 140B may be configured to transfer rotary movement to the rollers 130A, 130B, 132A, 132B to cause the rollers 130A, 130B, 132A, 132B to rotate the tubular member 102. In other embodiments, other rotary devices such as chains, gears, worm drives, etc. may be used instead of or in addition to the belts 140A, 140B to transfer the rotational movement.

The body 110 of the device 100 may also include a motor 150. The motor 150 may be configured to generate rotary movement that may be transferred to the arms 112A, 112B, the clamp, the rollers 130A, 130B, 132A, 132B, the belts 140A, 140B, or a combination thereof. As described in greater detail below, the rotary movement generated by the motor 150 may be configured to actuate the arms 112A, 112B between the open and closed positions. The rotary movement generated by the motor 150 may also or instead be configured to actuate the clamp between the unlocked and locked positions. The rotary movement generated by the motor 150 may be also or instead be configured to cause the belts 140A, 140B to move (e.g., rotate), as described below with reference to FIG. 4. The rotary movement generated by the motor 150 may be also or instead be configured to cause the rollers 130A, 130B, 132A, 132B to rotate the tubular member 102.

Figure 2:
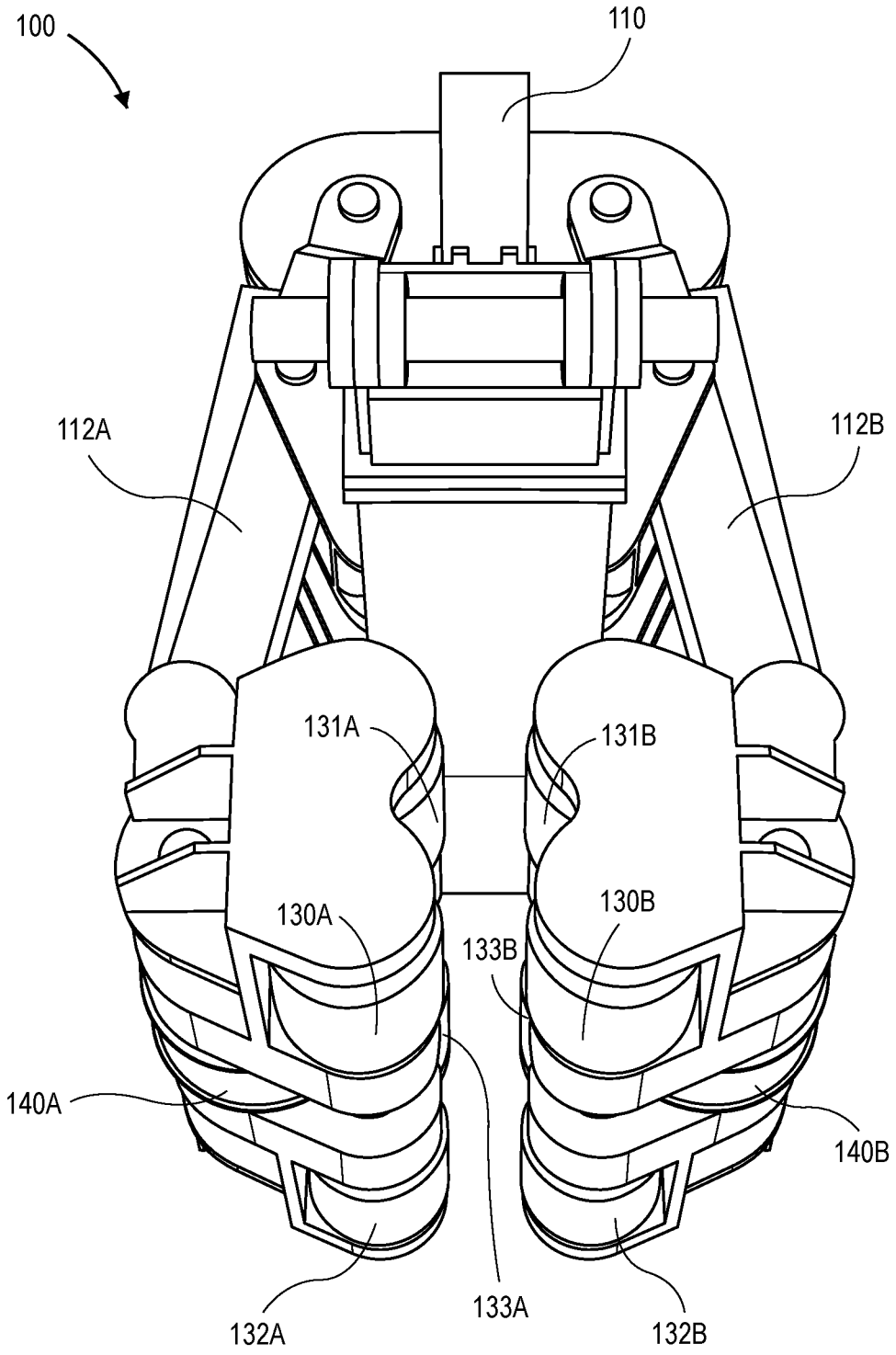
FIG. 2 illustrates a top, perspective view of the device, according to an embodiment.

FIG. 2 illustrates a top perspective view of the device 100, according to an embodiment. As shown, the first arm 112A may include two upper rollers 130A, 131A and two lower rollers 132A, 133A. Similarly, the second arm 112B may include two upper rollers 130B, 131B and two lower rollers 132B, 133B. When the arms 112A, 112B are in the closed position around the tubular member 102, the upper rollers 130A, 130B, 131A, 131B may each contact an outer surface of the tubular member 102 at four different points around the circumference of the tubular member 102 (e.g., about 90 degrees apart), and the lower rollers 132A, 132B, 133A, 133B may each contact the outer surface of the tubular member 102 at four different points around the circumference of the tubular member 102 102 (e.g., about 90 degrees apart). The upper rollers 130A, 130B, 131A, 131B may each contact the outer surface of the tubular member 102 at a first vertical location on the tubular member 102, and the lower rollers 132A, 132B, 133A, 133B may each contact the outer surface of the tubular member 102 at a second vertical location on the tubular member 102, where the first vertical location is different than (e.g., above) the second vertical location.

Figure 3:
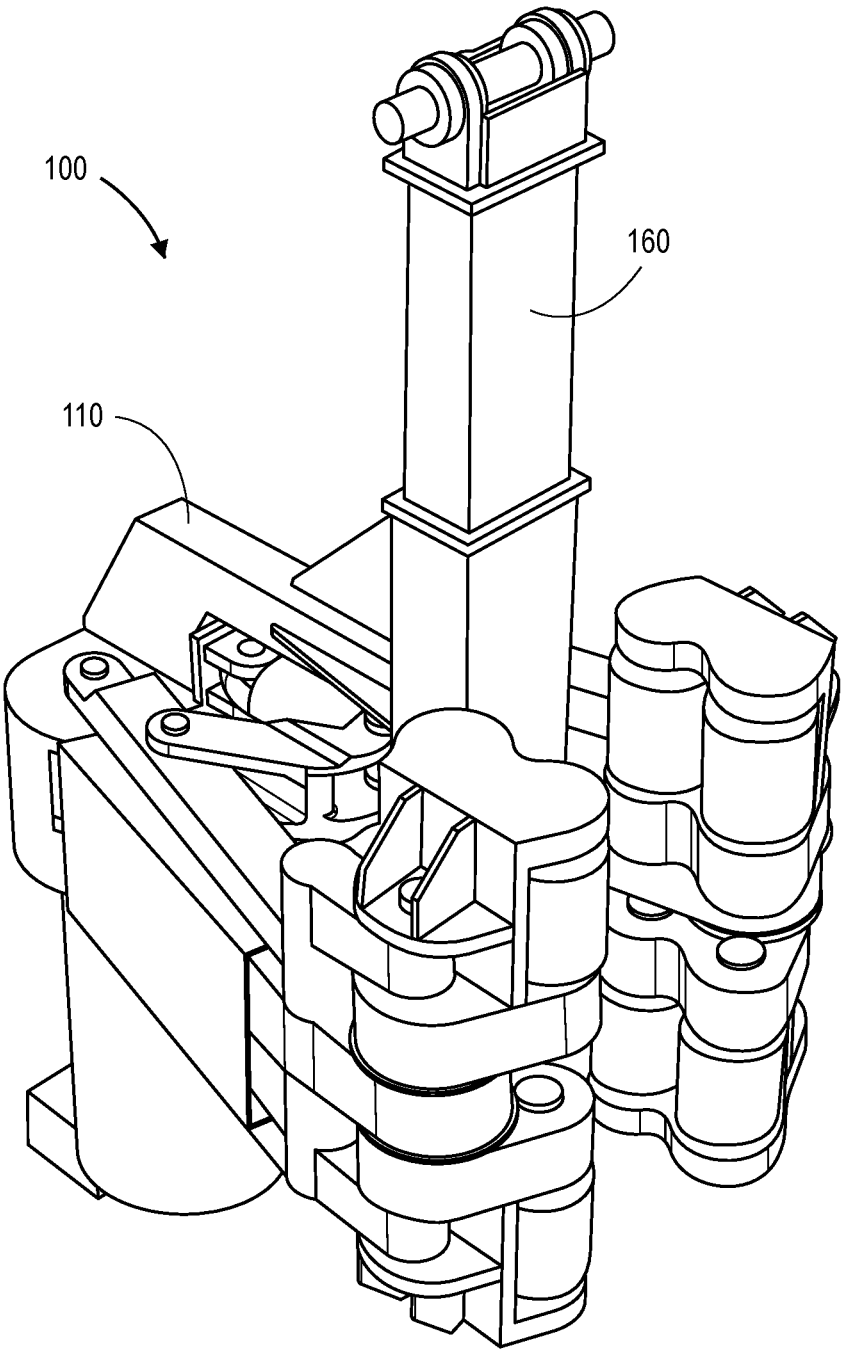
FIG. 3 illustrates a perspective view of the device with a neck in an extended position, according to an embodiment.

FIG. 3 illustrates a perspective view of the device 100 with a neck 160 of the device 100 in an extended position, according to an embodiment. The neck 160 may be coupled to the body 110, and may be configured to extend and retract (e.g., by telescoping). More particularly, the neck 160 may be configured to extend to move the body 110 vertically downward, and to retract to move the body 110 vertically upward. Accordingly, when the device 100 is gripping the tubular member 102, the neck 160 may extend to move the body 110 and the tubular member 102 vertically downward, and retract to move the body 110 and the tubular member 102 vertically upward. The neck 160 may be referred to as a vertical actuator.

Figure 4:
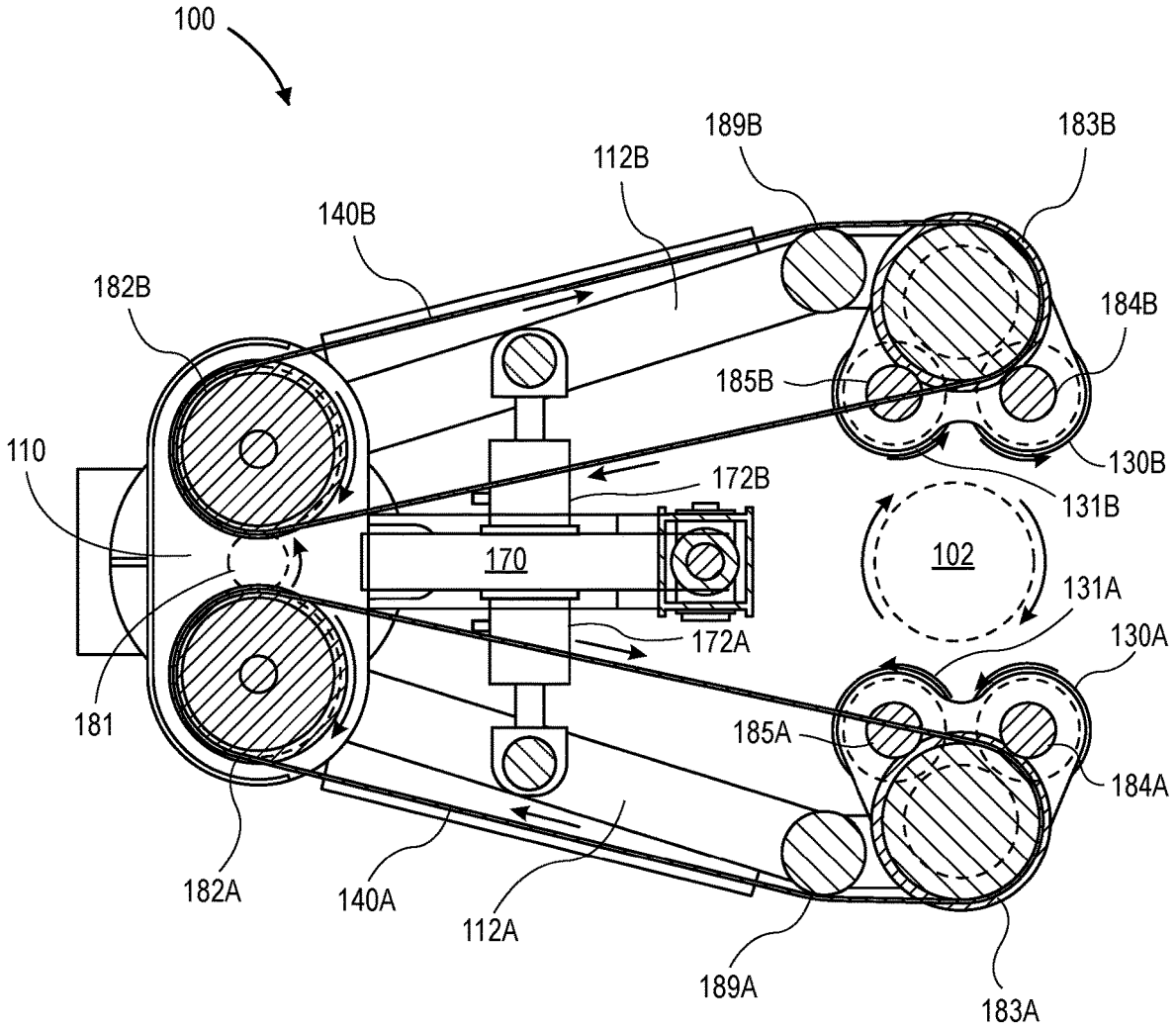
FIG. 4 illustrates a top, cross-sectional view of the device, according to an embodiment.

FIG. 4 illustrates a top, cross-sectional view of the device 100, according to an embodiment. The body 110 of the device 100 may include a central support 170. The body 110 may also include a first piston 172A that is coupled to and positioned at least partially between the central support 170 and the first arm 112A. Similarly, the body 110 may also include a second piston 172B that is coupled to and positioned at least partially between the central support 170 and the second arm 112B. The pistons 172A, 172B may be or include hydraulic or pneumatic cylinders that are configured to actuate between a first (e.g., extended) position (as shown) and a second (e.g., retracted) position. When the pistons 172A, 172B actuate (e.g., extend) into the first position, the arms 112A, 112B actuate into the open position, thereby providing space for the tubular member 102 to be received laterally into (or withdrawn laterally from) the arms 112A, 112B. When the pistons 172A, 172B actuate (e.g., retract) into the second position, the arms 112A, 112B actuate into the closed position, thereby securing the tubular member 102 between the arms 112A, 112B.

The body 110 of the device 100 may also include one or more gears (nine are shown: 181, 182A, 182B, 183A, 183B, 184A, 184B, 185A, and 185B) that may transfer the rotary movement from the motor 150 to the arms 112A, 112B, the clamp, and/or the rollers 130A-133A, 130B-133B. The gears 181, 182A, 182B, 183A, 183B, 184A, 184B, 185A, 185B may be or include pinions. More particularly, the body 110 may include a motor gear 181 that is coupled to the motor 150 (e.g., directly thereto via mounting a motor shaft). The motor 150 may cause the motor gear 181 to rotate. The motor gear 181 may rotate in a first direction to perform one operation, such as tubular make-up (e.g., screwing the tubular member 102 together with another tubular member. The motor gear 181 may also rotate in a second direction to perform another operation, such as tubular breakout (e.g., unscrewing the tubular member 102 from the other tubular member).

The body 110 of the device 100 may also include a rear first arm gear 182A coupled to a rear portion of the first arm 112A, and a rear second arm gear 182B coupled to a rear portion of the second arm 112B. The motor gear 181 may be positioned between and/or coupled to the rear arm gears 182A, 182B. The rotary movement of the motor gear 181 may be transferred to the rear arm gears 182A, 182B, causing them to rotate as well. As shown, the rear arm gears 182A, 182B may both rotate in a direction that is opposite to the motor gear 181 because the rear arm gears 182A, 182B are directly meshed with the motor gear 181.

The body 110 of the device 100 may also include a front first arm gear 183A coupled to a front portion of the first arm 112A. The first belt 140A may be coupled to (e.g., wrapped at least partially around) the first arm gears 182A, 183A. The rotary movement of the rear first arm gear 182A may be transferred to the first belt 140A, which may transfer the rotary movement to the front first arm gear 183A.

The body 110 of the device 100 may also include a front second arm gear 183B coupled to a front portion of the second arm 112B. The second belt 140B may be coupled to (e.g., wrapped at least partially around) the second arm gears 182B, 183B. The rotary movement of the rear second arm gear 182B may be transferred to the second belt 140B, which may transfer the rotary movement to the front second arm gear 183B. As shown, the belts 140A, 140B, the rear arm gears 182A, 182B, and the front arm gears 183A, 183B may rotate in the same direction.

The body 110 of the device 100 may also include one or more first arm upper gears (two are shown: 184A, 185B). The first arm upper gears 184A, 184B may be coupled to the first arm 112A, the front first arm gear 183A, and/or the first arm upper rollers 130A, 131A. The first arm upper gears 184A, 185A may be directly meshed with the front first arm gear 183A and/or the first arm upper rollers 130A, 131A. The rotary movement of the front first arm gear 183A may be transferred to the first arm upper gears 184A, 185A, which may transfer the rotary movement to the first arm upper rollers 130A, 131A. The first arm upper gears 184A, 185A may be positioned at least partially within the first arm upper rollers 130A, 131A, respectively.

The body 110 of the device 100 may also include one or more second arm upper gears (two are shown: 184B, 185B). The second arm upper gears 184B, 185B may be coupled to the second arm 112B, the front second arm gear 183B, and/or the second arm upper rollers 130B, 131B. The second arm upper gears 184B, 185B may be directly meshed with the front second arm gear 183B and/or the second arm upper rollers 130B, 131B. The rotary movement of the front second arm gear 183B may be transferred to the second arm upper gears 184B, 185B, which may transfer the rotary movement to the second arm upper rollers 130B, 131B. The second arm upper gears 184B, 185B may be positioned at least partially within the second arm upper rollers 130B, 131B, respectively.

The body 110 of the device 100 may also include a first arm router 189A and a second arm router 189B. The first arm router 189A is in contact with the first belt 140A and is configured to rotate together with the first belt 140A. The first arm router 189A is configured to redirect the direction of the first belt 140A from the rear first arm gear 182A to the front first arm gear 183A (e.g., so that the first belt 140A does not rub against the first arm upper gears 184A, 185A and/or the first arm upper rollers 130A, 130B). Similarly, the second arm router 189B is in contact with the second belt 140B and is configured to rotate together with the second belt 140B. The second arm router 189B is configured to redirect the direction of the second belt 140B from the rear second arm gear 182B to the front second arm gear 183B.

Although not shown in FIG. 4, the body 110 of the device 100 may also include one or more first arm lower gears and one or more second arm lower gears. The first arm lower gears may be coupled to the first arm 112A, the front first arm gear 183A, and the first arm lower rollers 132A, 133A. The rotary movement of the front first arm gear 183A may be transferred to the first arm lower gears, which may transfer the rotary movement to the first arm lower rollers 132A, 133A. Similarly, the second arm lower gears may be coupled to the second arm 112B, the front second arm gear 183B, and to the second arm lower rollers 132B, 133B. The rotary movement of the front second arm gear 183B may be transferred to the second arm lower gears, which may transfer the rotary movement to the second arm lower rollers 132B, 133B.

When the arms 112A, 112B are in the closed position and the rollers 130A-133A, 130B-133B are gripping the tubular member 102, the rotary movement of the rollers 130A-133A, 130B-133B may be transferred to the tubular member 102. Thus, the device 100 may be configured to grip the tubular member 102, transport the tubular member 102 from a first location to a second location while tubular member 102 is gripped, and rotate the tubular member 102 (e.g., in the second location). This provides efficiency in comparison to conventional wellsites that use two different devices to perform these functions.

Figure 5:
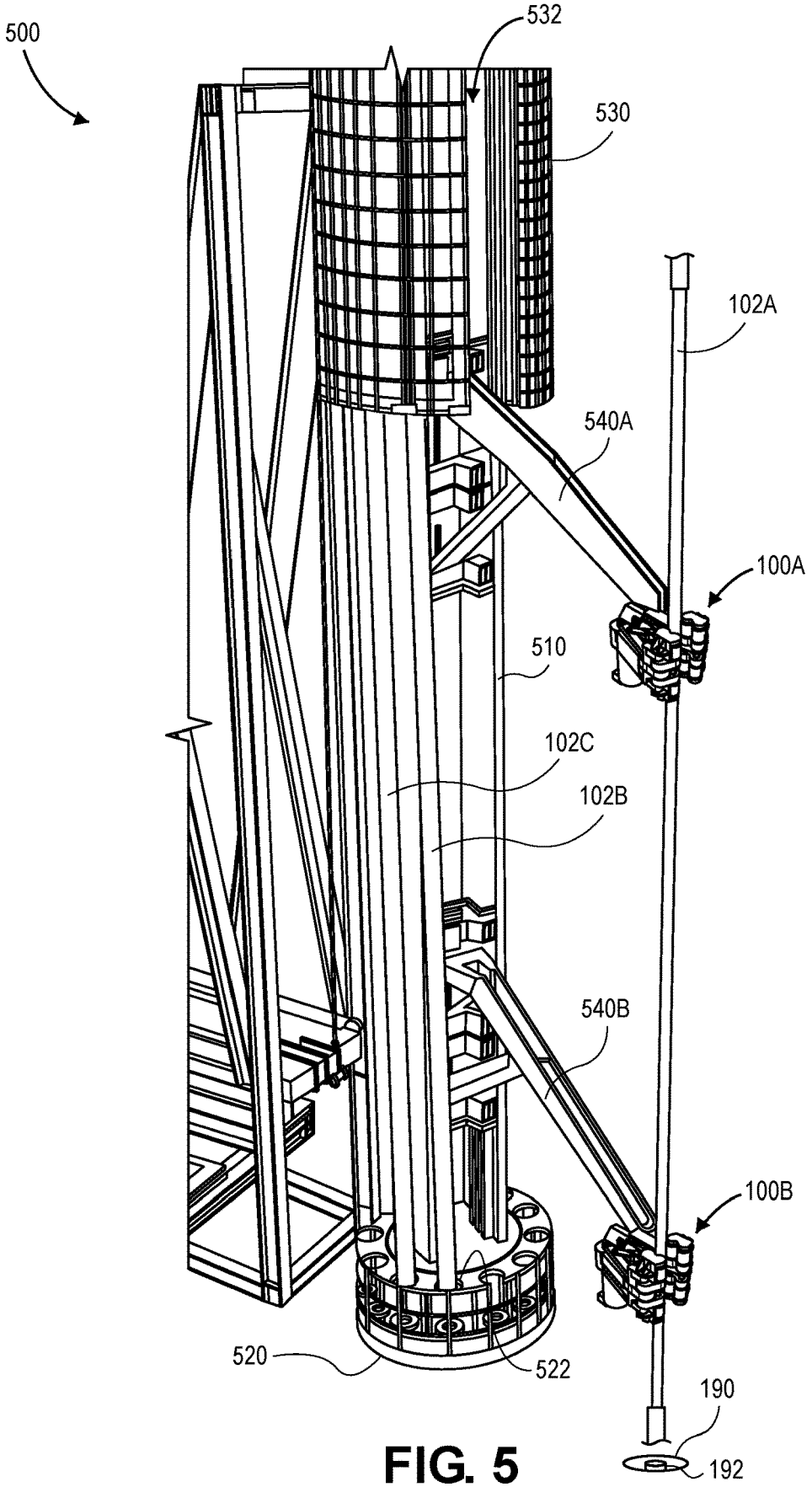
FIG. 5 illustrates a perspective view of a system including two devices, according to an embodiment.

FIG. 5 illustrates a perspective view of a system 500 for handling one or more tubular members (three are shown: 102A, 102B, 102C), according to an embodiment. The system 500 may include one or more of the devices 100 (e.g., two are shown: 100A, 100B). Having two or more devices 100A, 100B may provide stability to the tubular members 102A-102C while gripping, transporting, and/or rotating the tubular members 102A-102C. In one embodiment, the system 500 may be or include a rack (also referred to as a racker). For example, the system 500 may be or include a barrel buffer racker that is configured to store the one or more tubular members 102A-102C. At least a portion of the barrel buffer racker may be configured to rotate to facilitate distributing the tubulars 102A-102C therefrom.

The system 500 may include an elongated (e.g., substantially vertical) shaft 510. The system 500 may also include a lower holder 520 and an upper holder 530 that may hold (e.g., store) a plurality of tubular members 102B, 102C. The lower holder 520 may be coupled to a lower end of the shaft 510. The lower holder 520 may include a plurality of circumferentially-offset openings 522. Each opening 522 is configured to have a lower end of a tubular member 102B, 102C positioned therein.

The upper holder 530 may be coupled to an upper end of the shaft 510. The upper holder 530 may be positioned radially-outward from the shaft 510 such that the upper ends of the tubular members 102B, 102C being stored therein are positioned radially-between the shaft 510 and the upper holder 530. The upper holder 530 may include a vertical slot 532 through which one tubular member 102A-102C may pass laterally therethrough at a time, to remove the tubular member 102A-102C from the holders 520, 530, or to store the tubular member 102A-102C in the holders 520, 530.

The system 500 may also include a first (e.g., upper) actuator 540A that is coupled to and positioned between the shaft 510 and the first (e.g., upper) device 100A. Similarly, a second (e.g., lower) actuator 540B may be coupled to and positioned between the shaft 510 and the second (e.g., lower) device 100B. The actuators 540A, 540B and/or the devices 100A, 100B may be positioned vertically-between the holders 520, 530. The actuators 540A, 540B may be configured to move the devices 100A, 100B in one, two, or three dimensions (e.g., a horizontal plane and/or a vertical plane) with respect to the shaft 510. The actuators 540A, 540B may also be configured to move the tubular member 102A when the tubular member 102 is gripped by the devices 100A, 100B. In one embodiment, the actuators 540A, 540B may be referred to as horizontal actuators.

Figure 6:
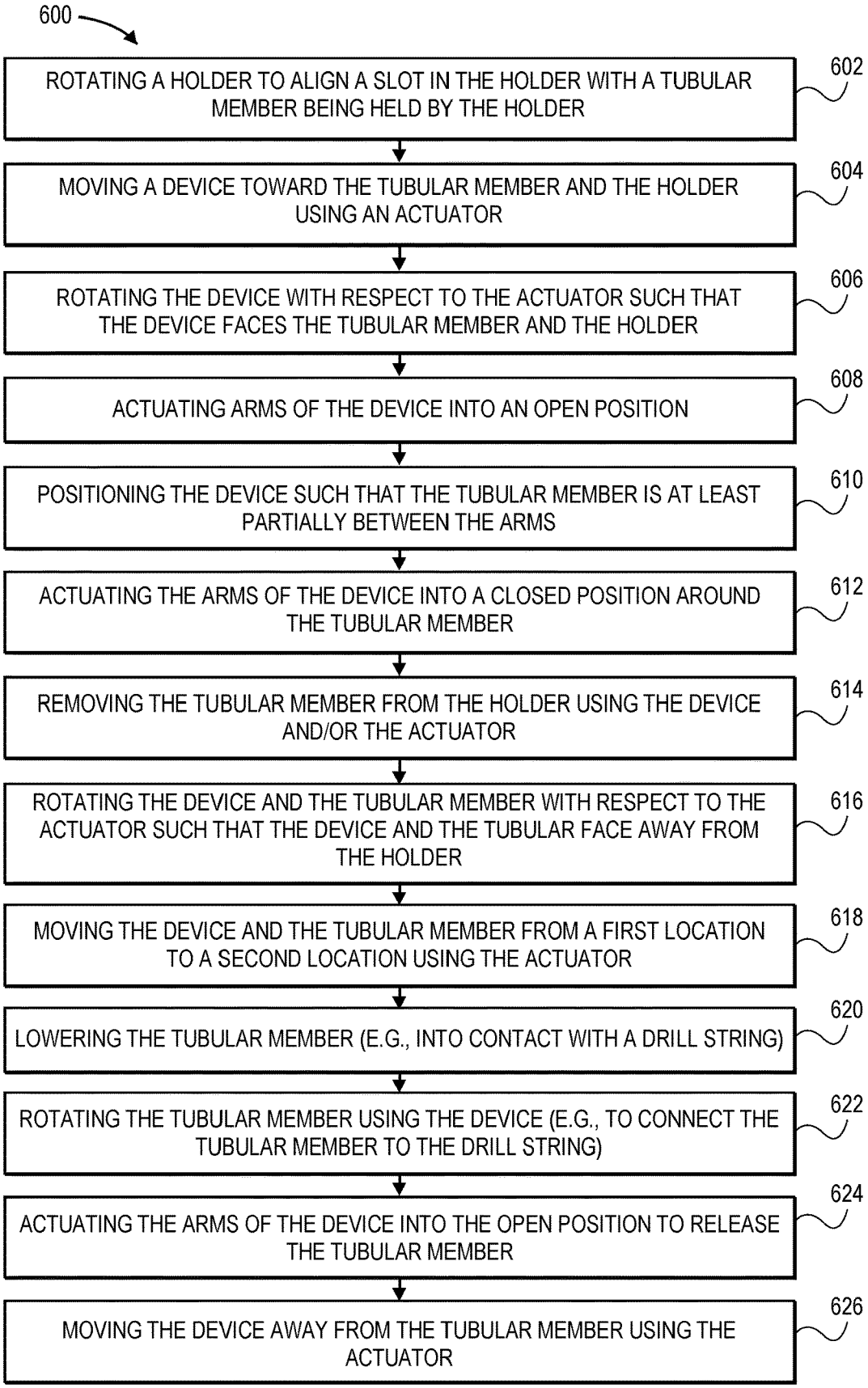
FIG. 6 illustrates a flowchart of a method for handling the tubular member, according to an embodiment.

FIG. 6 illustrates a flowchart of a method 600 for handling the tubular member(s) 102A-102C, according to an embodiment. An illustrative order of the method 600 is provided below; however, one or more portions of the method 600 may be performed in a different order, repeated, or omitted.

The method 600 is described with reference to the upper device 100A and the upper actuator 540A of the system 500. In one embodiment, the lower device 100B and the lower actuator 540B may operate simultaneously (e.g., in tandem) with the upper device 100A and the upper actuator 540B. In another embodiment, the lower device 100B and the lower actuator 540B may operate independently from the upper device 100A and the upper actuator 540B.

The tubular members 102A-102C may initially be stored in the holders 520, 530. More particularly, the lower ends of the tubular members 102A-102C may be positioned within the openings 522 of the lower holder 520, and the upper ends of the tubular members 102A-102C may be positioned within the upper holder 530.

The method 600 may include rotating the upper holder 530 to align the slot 532 with the tubular member 102A being held by/within the holders 520, 530, as at 602. The method 600 may also include moving the device 100A toward the tubular member 102A, as at 604. The device 100A may be moved toward the tubular member 102A, the shaft 510, and/or the holders 520, 530 using the actuator 540A.

The method 600 may also include rotating the device 100A, as at 606. More particularly, the device 100A may be rotated (e.g., about 180 degrees) with respect to the actuator 540 so that the arms 112A, 112B face toward the tubular member 102A, the shaft 510, and/or the holders 520, 530.

The method 600 may also include actuating the arms 112A, 112B of the device 100A into the open position, as at 608. As discussed above, this may include actuating the pistons 172A, 172B into the first position, causing the arms 112A, 112B to move into the open position.

The method 600 may also include positioning the device 100A such that the tubular member 102A is at least partially between the arms 112A, 112B, as at 610. The device 100A may be moved into this position using the actuator 540A. The method 600 may also include actuating the arms 112A, 112B of the device 100A into the closed position around the tubular member 102A, as at 612. As discussed above, this may include actuating the pistons 172A, 172B into the second position, causing the arms 112A, 112B to move into the closed position. In the closed position, the rollers 130A-133A, 130B-133B may contact (e.g., grip) the tubular member 102A.

The method 600 may also include removing the tubular member 102A from the holders 520, 530, as at 614. The tubular member 102A may be removed from the holders 520, 530 using the device 100A, the actuator 540A, or both. In one embodiment, the neck 160 may be in the extended position when the device 100 grips the tubular member 102A. In this embodiment, removing the tubular member 102A may include retracting the neck 160, which may lift the body 110 and the tubular member 102A, such that the tubular member 102A is lifted out of the opening 522 in the lower holder 520. The actuator 540A may then move the device 100 and the tubular member 102A laterally-away from the holders 520, 530 such that the tubular member 102A passes laterally-through the slot 532 in the upper holder 530.

The method 600 may also include rotating the device 100A and the tubular member 102A, as at 616. More particularly, the device 100A and the tubular member 102A may be rotated (e.g., about 180 degrees) with respect to the actuator 540 so that the arms 112A, 112B and the tubular member 102A face away from the shaft 510 and/or the holders 520, 530.

The method 600 may also include moving the tubular member 102A from a first location to a second location, as at 618. The first location may be positioned at least partially within the holders 520, 530. In one embodiment, the second location may be in alignment with a wellbore 190. The actuator 540A may move the device 100A and the tubular member 102A into alignment with the wellbore 190. In at least one embodiment, a tubular string (e.g., a drill string) 192 may be positioned at least partially within the wellbore 190, and the actuator 540A may move the device 100A and the tubular member 102A into alignment with the tubular string 192. The device 100A and the tubular member 102A may be positioned above the wellbore 190 and/or the tubular string 192. The tubular string 192 may include a plurality of tubular members that are coupled together.

The method 600 may also include lowering the tubular member 102A, as at 620. In one embodiment, the device 100 and the tubular member 102A may be lowered using the actuator 540A. In another embodiment, the tubular member 102A may also or instead be lowered by extending the neck 160 of the device 100, such that the body 110 and the tubular member 102A are lowered with respect to the actuator 540A. In at least one embodiment, lowering the tubular member 102A may cause a lower end of the tubular member 102A to contact (e.g., be stabbed into) an upper end of the tubular string 192.

The method 600 may also include rotating the tubular member 102A, as at 622. The tubular member 102A may be rotated using the device 100A. More particularly, once the lower end of the tubular member 102A is placed in contact (e.g., stabbed into) the upper end of the tubular string 192, the motor 150 may cause the rollers 130A-133A, 130B-133B to rotate. As discussed above, the motor 150 may cause the motor gear 181 to rotate, which may cause the rear arm gears 182A, 182B to rotate. In turn, this may cause the belts 140A, 140B to rotate, which may cause the front arm gears 183A, 183B to rotate, which may cause the roller gears 184A, 184B, 185A, 185B to rotate. In turn, this may cause the rollers 130A-133A, 130B-133B to rotate, which may cause the tubular member 102A to rotate. The rotation of the tubular member 102A may couple the tubular member 102A to the tubular string 192. For example, the rotation may screw the tubular member 102A and the tubular string 192 together, making the tubular member 102A a part of the tubular string 192, thus increasing the length of the tubular string 192.

The method 600 may also include actuating the arms 112A, 112B of the device 100A into the open position to release the tubular member 102A, as at 624. As discussed above, this may include actuating the pistons 172A, 172B back into the first position, causing the arms 112A, 112B to move into the open position.

The method 600 may also include moving the device 100A away from the tubular member 102A, as at 626. In other words, after the tubular member 102A is coupled to the drill string 192, the arms 112A, 112B may be opened, and the device 100A may be moved such that the tubular member 102A is withdrawn from the arms 112A, 112B. The device 100A may be moved away from the tubular member 102A using the actuator 540A.

The method 600 may then loop back around to 602 and repeat to add additional tubular members 102B, 102C to the tubular string 192. The method 600 may be performed in a different (e.g., reverse) order to disconnect and remove tubular members from the tubular string 192 and place them into the holders 520, 530.

The lower device 100B and the lower actuator 540B may operate simultaneously (e.g., in tandem) with the upper device 100A and the upper actuator 540B. For example, both devices 100A, 100B may be configured to grip, transport, and/or rotate the same tubular member 102A simultaneously. As mentioned above, this may provide support to the tubular members 102A-102C so that they do not become misaligned with a vertical axis. In another embodiment, the lower device 100B and the lower actuator 540B may operate independently from the upper device 100A and the upper actuator 540B, allowing the system 500 to grip, transport, and/or rotate two different tubular members (e.g., tubular members 102A, 102B) simultaneously. For example, the upper device 100A and the upper actuator 540A may be used to rotate the tubular member 102A to couple the tubular member 102A to the drill string 192, while the lower device 100B and the lower actuator 540B may be used to (e.g., simultaneously) grip and/or remove the tubular member 102B from the holders 520, 530.

As used herein, the terms "inner" and "outer"; "up" and "down"; "upper" and "lower"; "upward" and "downward"; "upstream" and "downstream"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A system for handling a tubular member, comprising:

a gripping assembly configured to grip the tubular member;

a horizontal actuator configured to move the gripping assembly and the tubular member horizontally between a rack and alignment with a wellbore while the tubular member is gripped by the gripping assembly;

a vertical actuator coupled to the gripping assembly, the horizontal actuator, or both, wherein the vertical actuator is configured to move the gripping assembly and the tubular member vertically while the tubular member is gripped by the gripping assembly and in alignment with the wellbore; and a rotating assembly coupled to the gripping assembly and configured to rotate the tubular member while the tubular member is gripped by the gripping assembly and in alignment with the wellbore, wherein the vertical actuator comprises a neck that is coupled to and positioned at least partially between the gripping assembly and the horizontal actuator, wherein the neck is configured to extend and retract vertically, and wherein the gripping assembly and the tubular member are lowered when the neck extends and the tubular member is gripped by the gripping assembly.

2. The system of claim 1, wherein the gripping assembly comprises a first arm and a second arm that are configured to actuate between an open position and a closed position.

3. The system of claim 2, wherein the rotating assembly comprises:

one or more first rollers coupled to the first arm; and one or more second rollers coupled to the second arm, wherein the one or more first and second rollers are configured to grip and rotate the tubular member when the first and second arms are in the closed position to connect the tubular member to a tubular string in the wellbore or to disconnect the tubular member from the tubular string in the wellbore.

4. The system of claim 3, wherein the one or more first rollers comprise an upper first roller and a lower first roller, wherein the one or more second rollers comprise an upper second roller and a lower second roller, and wherein the upper first and second rollers are configured to contact the tubular member vertically-above where the lower first and second rollers are configured to contact the tubular member.

5. The system of claim 3, wherein the one or more first rollers comprise two first rollers, wherein the one or more second rollers comprise two second rollers, and wherein the two first rollers and the two second rollers are configured to contact the tubular member at different locations around a circumference of the tubular member.

6. The system of claim 3, further comprising:
a motor;
a motor gear configured to be rotated by the motor;
a rear first arm gear configured to be rotated by the motor gear;
a first belt configured to be rotated by the rear first arm gear;
a front first arm gear configured to be rotated by the first belt; and
a first roller gear configured to be rotated by the front first arm gear, wherein the one or more first rollers are configured to be rotated by the first roller gear.

7. The system of claim 6, further comprising:
a rear second arm gear configured to be rotated by the motor gear;
a second belt configured to be rotated by the rear second arm gear;
a front second arm gear configured to be rotated by the second belt; and
a second roller gear configured to be rotated by the front second arm gear, wherein the one or more second rollers are configured to be rotated by the second roller gear.

8. The system of claim 1, wherein the horizontal actuator is coupled to and positioned at least partially between the rack and the neck.

9. The system of claim 1, wherein the gripping assembly is configured to rotate with respect to the horizontal actuator from a first rotational position that faces toward the rack to a second rotational position that faces away from the rack.

10. A system for handling a tubular member, comprising:
a rack comprising:
a shaft; and
a holder coupled to the shaft, wherein the tubular member is configured to be stored at least partially within the holder;
a first horizontal actuator coupled to the rack; and
a first device coupled to the first horizontal actuator, wherein the first device comprises:
a gripping assembly configured to grip the tubular member; and
a rotating assembly coupled to the gripping assembly and configured to rotate the tubular member while the tubular member is gripped by the gripping assembly,
wherein:
the gripping assembly is configured to actuate between an open position and a closed position,
the first horizontal actuator is configured to move the first device such that the tubular member becomes positioned at least partially within the gripping assembly when the gripping assembly is in the open position,
the gripping assembly is configured to grip the tubular member when the gripping assembly is in the closed position,
the first horizontal actuator is configured to move the first device and the tubular member away from the rack while the tubular member is gripped by the gripping assembly, and
the rotating assembly is configured to rotate the tubular member after the first device and the tubular member have been moved away from the rack and while the tubular member is gripped by the gripping assembly,
wherein first device further comprises:
a motor;
a motor gear configured to be rotated by the motor;
a rear first arm gear configured to be rotated by the motor gear;
a first belt configured to be rotated by the rear first arm gear;
a front first arm gear configured to be rotated by the first belt; and
a first roller gear configured to be rotated by the front first arm gear,
wherein the rotating assembly comprises one or more first rollers that are configured to be rotated by the first roller gear.

11. The system of claim 10, wherein the first horizontal actuator is configured to move the first device and the tubular member away from the rack and toward a tubular string that is positioned at least partially within a wellbore while the tubular member is gripped by the gripping assembly, and wherein the rotating assembly is configured to rotate the tubular member to couple the tubular member to the tubular string.

12. The system of claim 11, wherein the first device further comprises a vertical actuator that is coupled to the first horizontal actuator and the gripping assembly, and wherein the vertical actuator is configured to extend to lower the gripping assembly and the tubular member, with respect to the first horizontal actuator, to cause the tubular member to contact the tubular string.

13. The system of claim 10, further comprising:
a second horizontal actuator coupled to the rack; and
a second device coupled to the second horizontal actuator,
wherein the holder comprises:
an upper holder defining a slot; and
a lower holder defining an opening,
wherein the upper holder, the lower holder, or both is rotated to circumferentially-align the tubular member with the slot prior to removing the tubular member from the upper and lower holders, and
wherein the first and second horizontal actuators and the first and second devices are positioned vertically-between the upper holder and the lower holder.

14. A method for handling a tubular member, comprising:
moving a device toward the tubular member using a horizontal actuator coupled to the device;
actuating a gripping assembly of the device into an open position;
positioning the device such that the tubular member is at least partially within the gripping assembly;
actuating the gripping assembly into a closed position such that the gripping assembly contacts and grips the tubular member;
moving the tubular member from a first location to a second location using the device and the horizontal actuator while the tubular member is gripped by the gripping assembly; and
rotating the tubular member using a rotating assembly of the device when the tubular member is in the second location and the tubular member is gripped by the gripping assembly,
wherein the tubular member is initially positioned within a rack, and wherein the method further comprises:
rotating at least a portion of the rack such that a slot in the rack is aligned with the tubular member in the rack; and
rotating the device, with respect to the horizontal actuator, such that the gripping assembly faces the tubular member in the rack prior to positioning the device such that the tubular member is at least partially within the gripping assembly, wherein the first location is in the rack, wherein the second location is in alignment with a wellbore, and wherein a tubular string is positioned at least partially in the wellbore, and wherein the method further comprises lowering the device and the tubular member until the tubular member contacts the tubular string prior to rotating the tubular member, and wherein lowering the device and the tubular member comprises extending a vertical actuator such that the gripping assembly and the tubular member are lowered with respect to the horizontal actuator.

15. The method of claim 8, wherein rotating the tubular member comprises rotating a motor gear with a motor, which causes a rear first arm gear to be rotated, which causes a first belt to be rotated, which causes a front first arm gear to be rotated, which causes a first roller gear to be rotated, which causes a first roller to be rotated, wherein the first roller contacts the tubular member when the gripping assembly is in the closed position, and wherein the first roller is configured to rotate the tubular member.

* * * * *